US006089733A

United States Patent [19]

Chen

[11] Patent Number: 6,089,733

[45] Date of Patent: Jul. 18, 2000

[54] PENDANT ELEVATION AND PROJECTING ANGLE ADJUSTING STRUCTURE

[76] Inventor: Meiric Chen, 73-31 Chiun Lin S. Rd, Hsin Chuang City, Taipei Hsien, Taiwan

[21] Appl. No.: 09/244,336

[22] Filed: Feb. 3, 1999

[51] Int. Cl.[7] ..... F21V 21/16

[52] U.S. Cl. ..... 362/407; 362/391; 362/408; 362/288; 362/453; 362/403

[58] Field of Search ..... 362/391, 403, 362/404, 407, 408, 288, 451, 453

[56] References Cited

U.S. PATENT DOCUMENTS

| | | | |
|---|---|---|---|
| 47,312 | 4/1865 | Loth . | |
| 837,349 | 12/1906 | Smith | 362/407 |
| 5,317,493 | 5/1994 | Muller et al. | 362/407 |

*Primary Examiner*—Sandra O'Shea
*Assistant Examiner*—Ali Alavi
*Attorney, Agent, or Firm*—Pro-Techtor International Services

[57] ABSTRACT

A pendant elevation and projecting angle adjusting structure includes a locating disk fixedly fastened to the bottom end of a suspension rod at the ceiling, a plurality of pull ropes respectively inserted through equiangularly spaced wire holes at the locating disks, a lampshade and a balance plate respectively suspended from the ends of the pull rods below the locating disk, and a power cord inserted through the suspension rod and connected to the lampshade, wherein the lampshade is tilted to change the light projecting angle of the lamp bulb when one pull rope is pulled; the elevation of the lampshade is changed when the balance plate is pulled downwards or lifted.

3 Claims, 8 Drawing Sheets

PENDANT ELEVATION AND PROJECTING ANGLE ADJUSTING STRUCTURE

BACKGROUND OF THE INVENTION

The present invention relates to a pendant, and more specifically to a pendant elevation and projecting angle adjusting structure which allows the user to adjust its elevation and light projecting angle conveniently.

FIG. 1 shows a regular pendant. The structure of pendant comprises a holder C fixedly fastened to the ceiling, a lamp A suspended from the holder C, and a suspension rod (or cable) B having a top end connected to the holder C and a bottom end connected to the lamp A. Because the lamp A is suspended from the holder C by the suspension rod (or cable) B, it is inconvenient to change the elevation of the lamp A. When changing the elevation of the lamp A, a ladder may have to be used so that the user can reach to the suspension rod (or cable) B, enabling the suspension rod (or cable) B to be replaced with a new one, or changed to the desired length. Furthermore, because the lamp A is directly suspended from the suspension rod (or cable) B, its light projecting angle is not adjustable.

SUMMARY OF THE INVENTION

The present invention has been accomplished to provide a pendant elevation and projecting angle adjusting structure which eliminates the aforesaid drawbacks. According to the present invention, the pendant elevation and projecting angle adjusting structure comprises a locating disk fixedly fastened to the bottom end of a suspension rod at the ceiling, a plurality of pull ropes respectively inserted through equiangularly spaced wire holes at the locating disks, a lampshade and a balance plate respectively suspended from the ends of the pull rods below the locating disk, and a power cord inserted through the suspension rod and connected to the lampshade. When one pull rope is pulled downwards, the lampshade is tilted in one direction, and therefore the light projecting angle of the lamp bulb is relatively adjusted. When the balance plate is pulled downwards or lifted, the elevation of the lampshade (the lamp bulb) is relatively changed.

DETAILED DESCRIPTION OF THE PREFERRED EMBODIMENT

Figure 1:
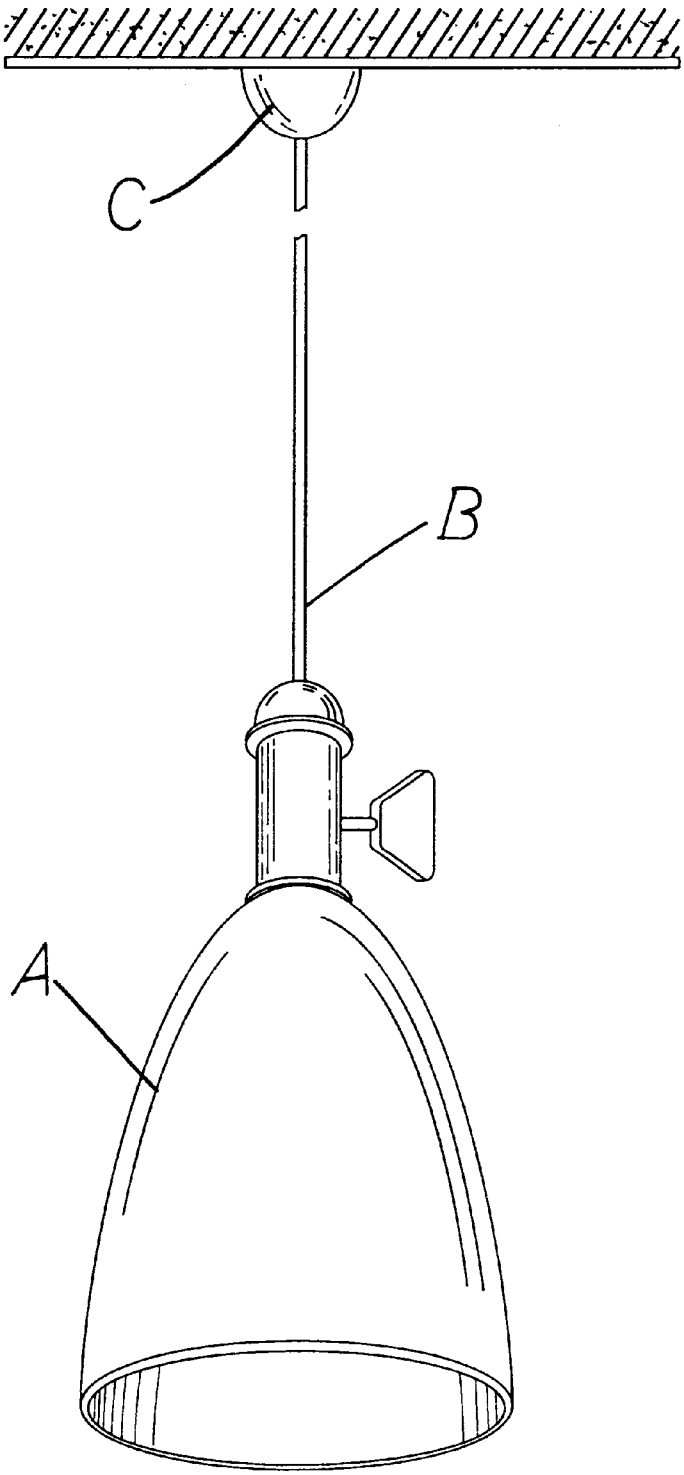
FIG. 1 PRIOR ART
FIG. 1 is a prior art pendant.
Figure 2:
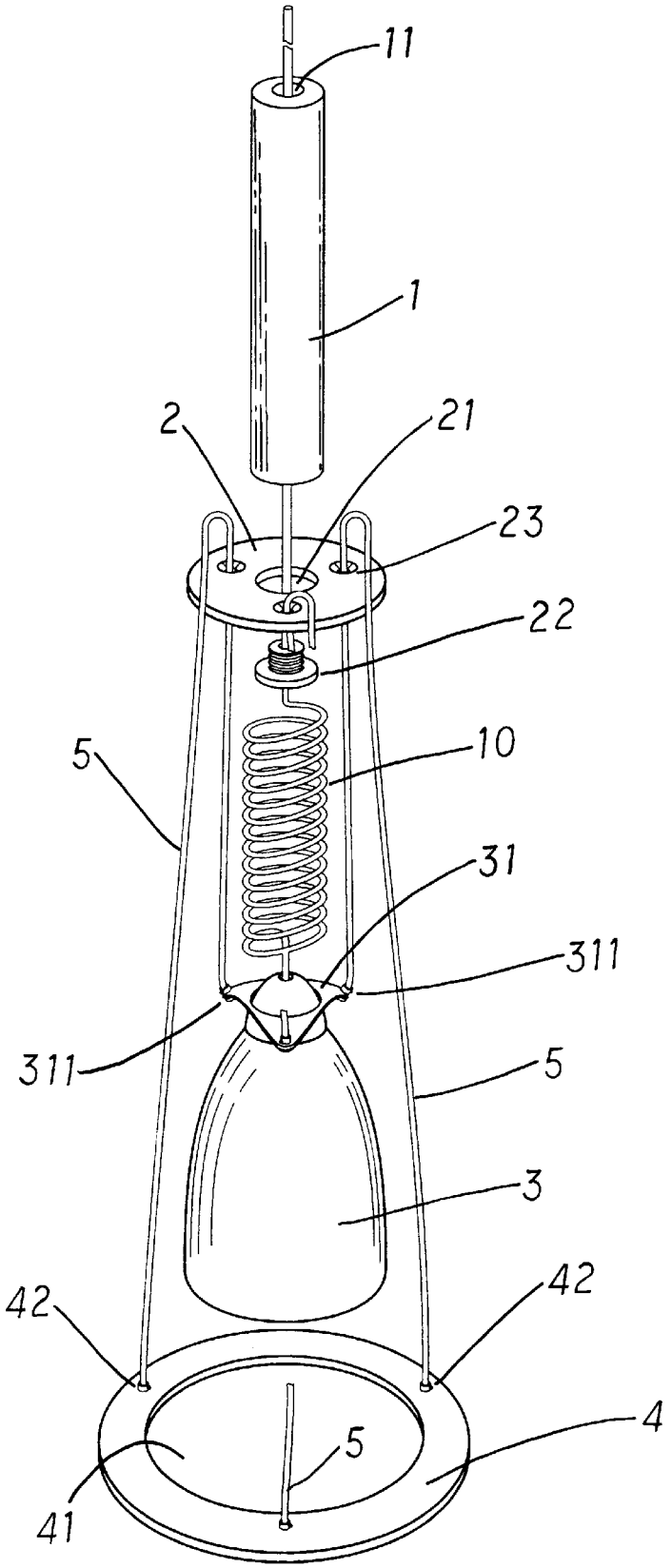
FIG. 2 is a perspective view of the pendant adjusting structure of the present invention.

Referring to FIGS. from 2 through 4, a pendant elevation and projecting angle adjusting structure in accordance with the present invention is generally comprised of a suspension rod 1, a locating disk 2, a lampshade 3, a balance plate 4, three pull ropes 5, and a power cord 10. The suspension rod 1 is fastened to a holder at the ceiling in a vertical position, having an axial center through hole 11. The locating disk 2 comprises a center through hole 21, and a plurality of wire holes 23 equiangularly spaced around the center through hole 21. A hollow screw cap 22 is mounted in the center through hole 21, and threaded into an inner thread (not shown) in the axial center through hole 11 of the suspension rod 1 to fix the locating disk 2 to the bottom end of the suspension rod 1. The power cord 10 is inserted through the axial center through hole 11 of the suspension rod 1, having a top end connected to power source, and a bottom end inserted through the hollow screw cap 22 and connected to the lampshade 3. The lampshade 3 is suspended below the locating disk 2 and holds a lamp bulb (not shown) on the inside in connection to the power cord 10, having a top rack 31. The top rack 31 of the lampshade 3 has three mounting ends 311. The balance plate 4 is suspended from the locating disk 2 at a distance by the ropes 5, comprising a circular center through hole 41 for the passing of the lampshade 3, and three connecting points 42 equiangularly spaced around the circular center through hole 41. The balance plate 4 has a certain weight. Preferably, the weight of the balance plate 4 is approximately equal to the lampshade 3, so that the lampshade 3 and the balance plate 4 can be stably suspended from the locating disk 2 by the pull ropes 5. The pull ropes 5 are respectively inserted through the wire holes 23 at the locating disk 2, each having a first end respectively connected to the mounting ends 311 of the top rack 31 of the lampshade 3, and a second end respectively connected to the connecting points 42 at the balance plate 4.

Figure 5:
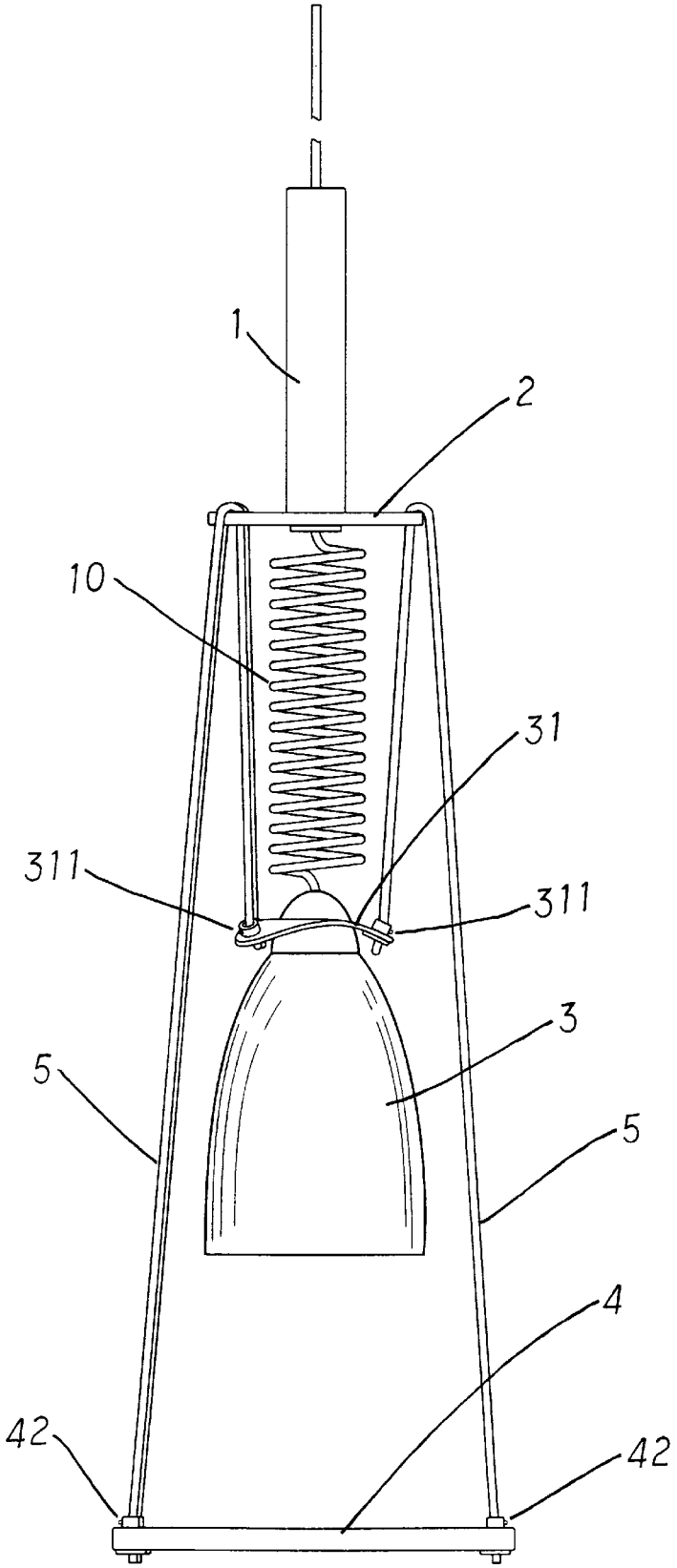
FIG. 5 is a front view with the power cord retracted.
Figure 6:
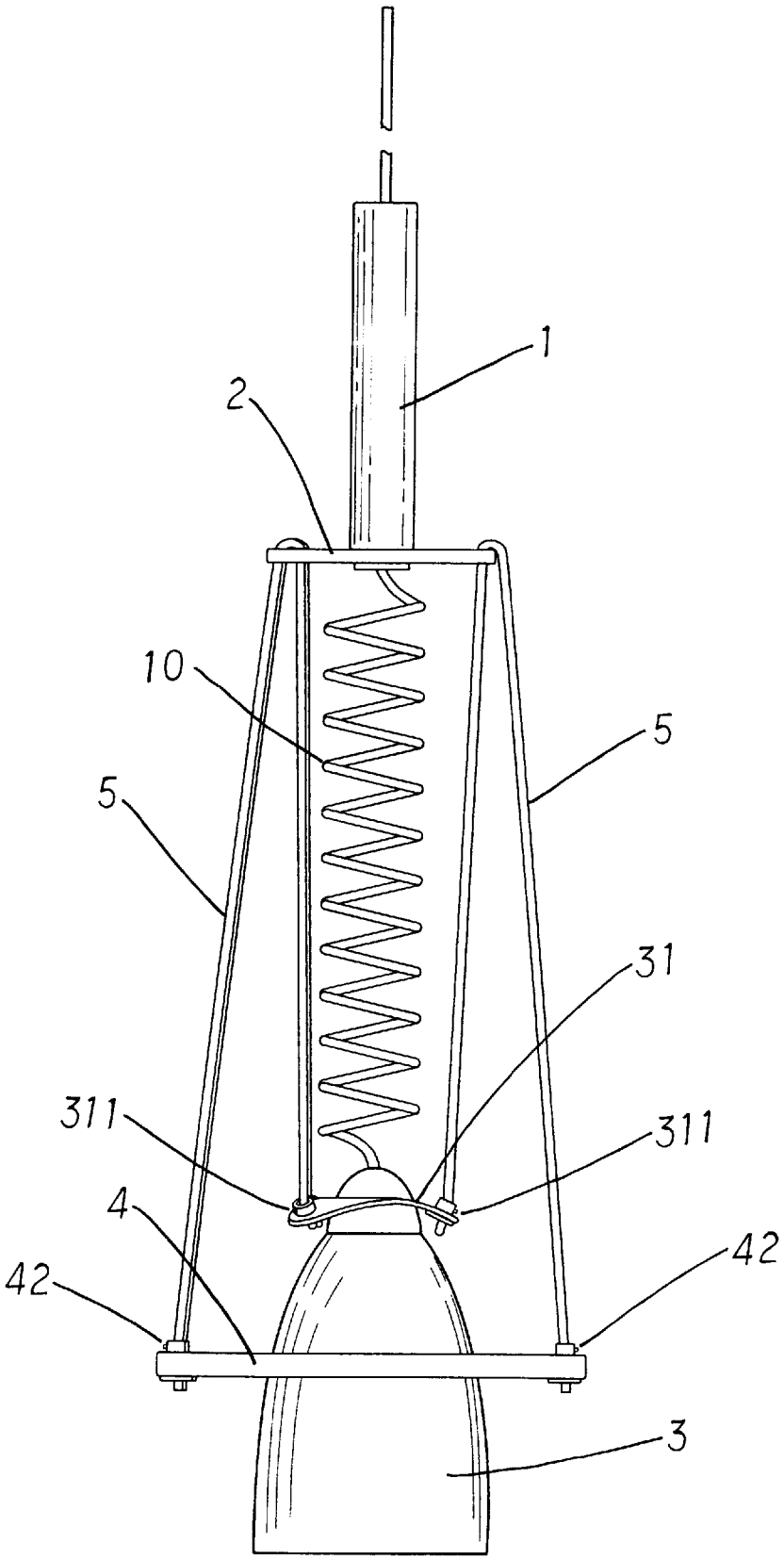
FIG. 6 is a front view with the lamp shade pulled through the balance plate.

Referring to FIGS. 5 and 6, because the pull ropes 5 are respectively inserted through the wire holes 23 at the locating disk 2 and connected between the mounting ends 311 of the top rack 31 of the lampshade 3 and the connecting points 42 at the balance plate 4, the lampshade 3 and the balance plate 4 are respectively suspended from the locating disk 2 by the pull ropes 5, and can be relatively adjusted to change their elevations. Therefore, when the balance plate 4 is pulled downwards, the lampshade 3 is relatively lifted. On the contrary, when the lampshade 3 is pulled downwards, the balance plate 4 is lifted.

Figure 7:
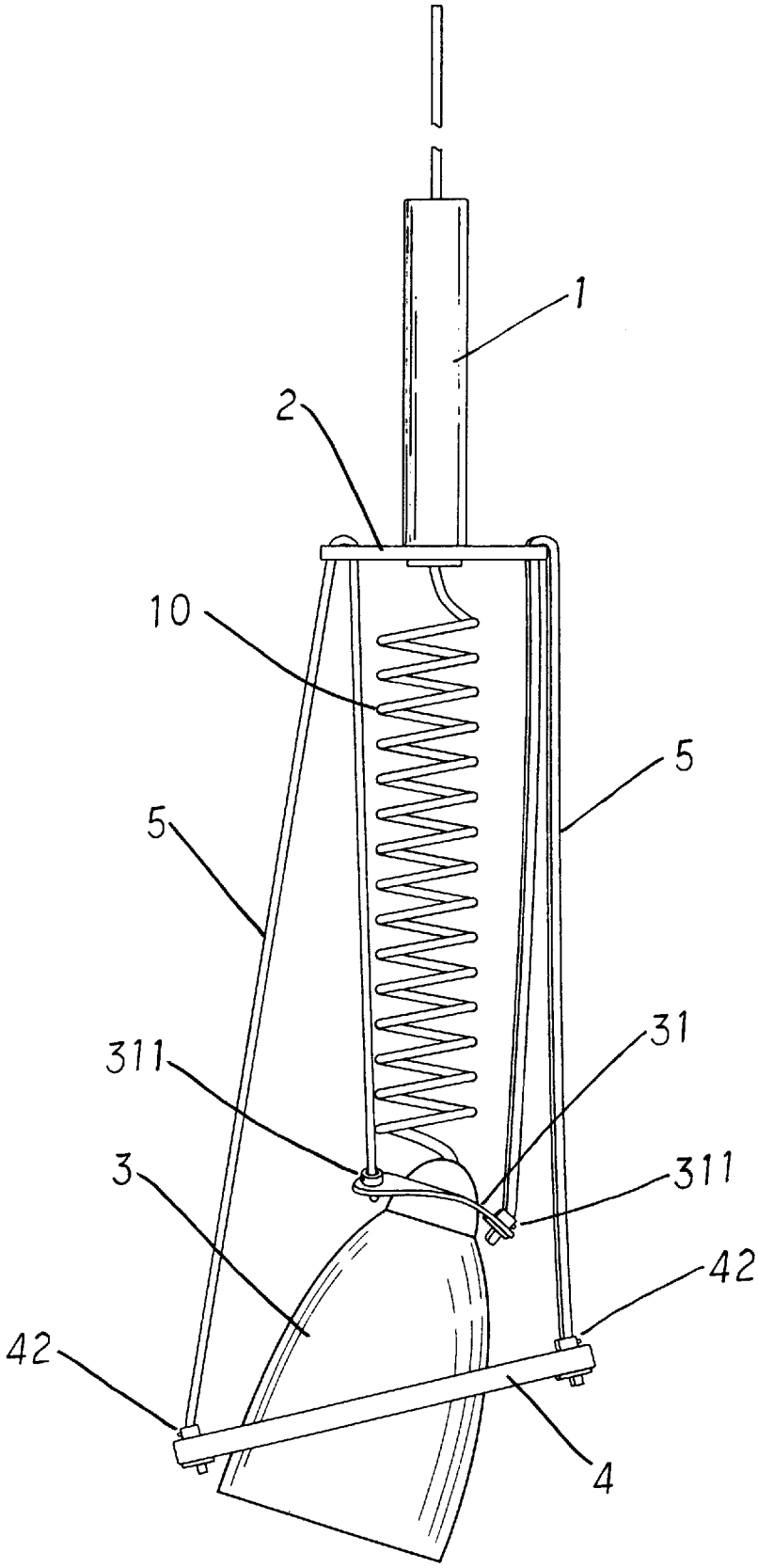
FIG. 7 shows the device positioned at an angle.
Figure 8:
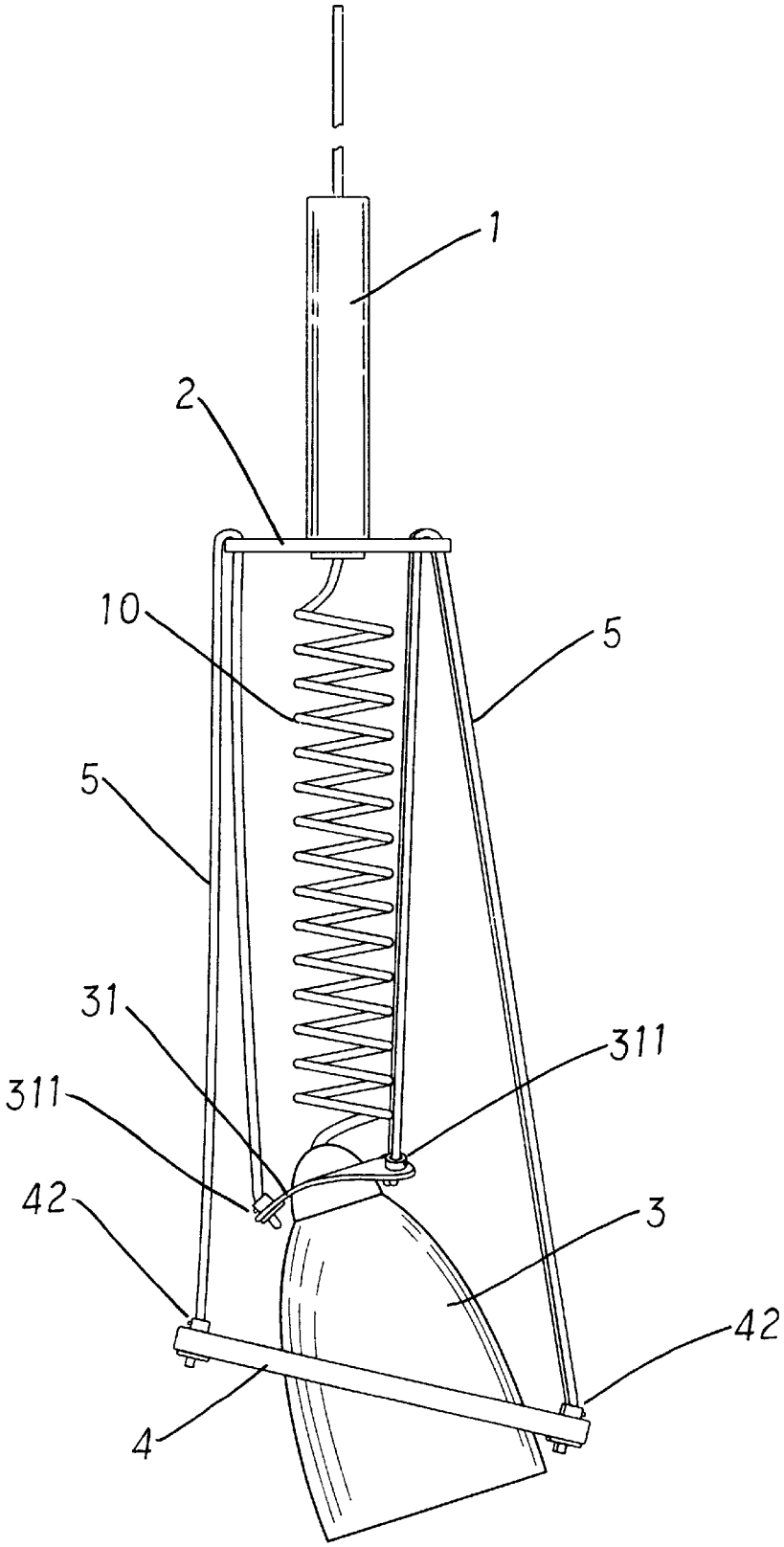
FIG. 8 shows the device positioned at another angle.

Referring to FIGS. 7 and 8, when one pull rope 5 is pulled downwards, the lampshade 3 is tilted in one direction, and therefore the light projecting angle of the lamp bulb in the lampshade 3 is relatively changed.

Figure 3:
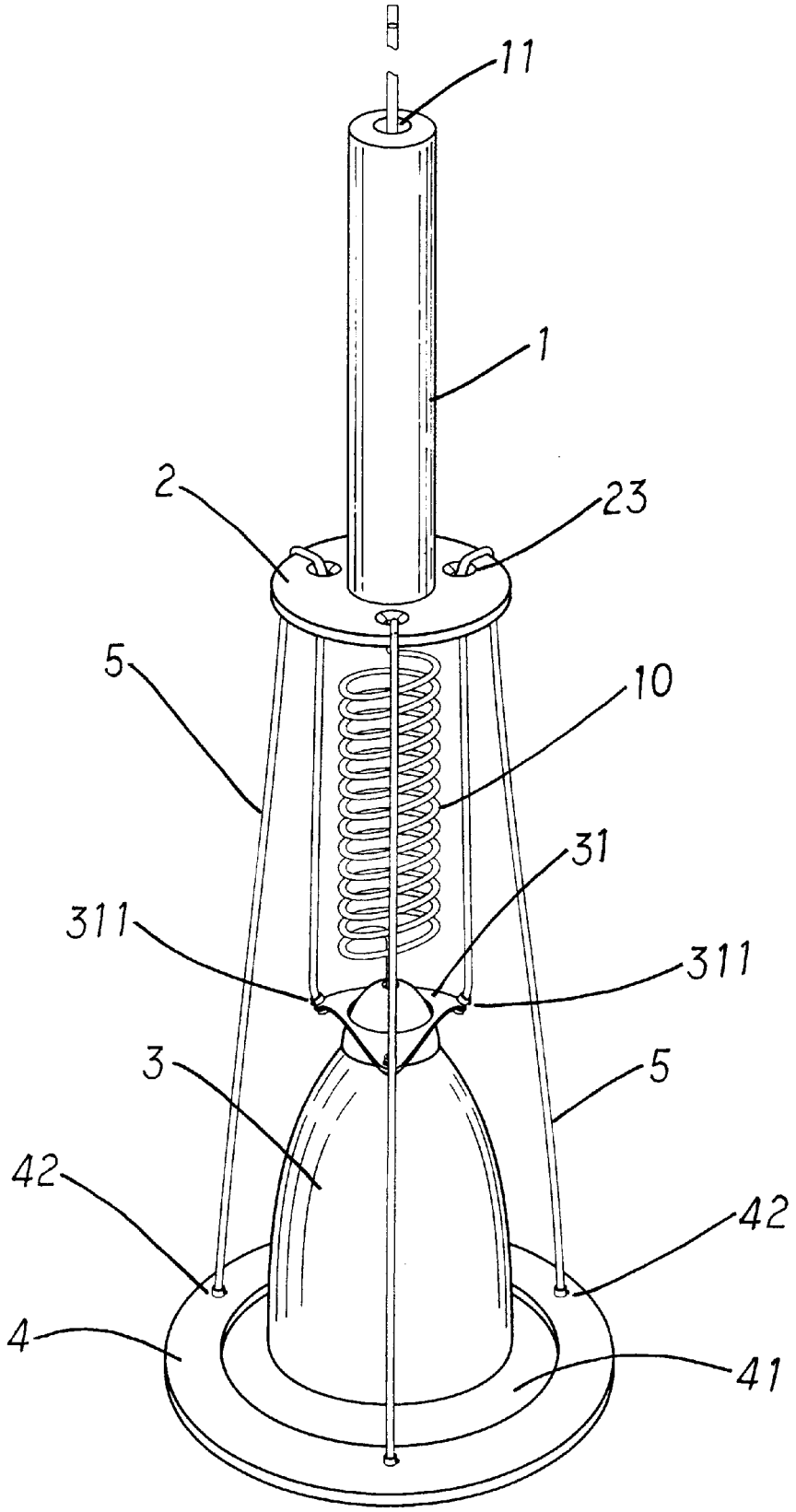
FIG. 3 is another perspective view of the pendant adjusting structure.
Figure 4:
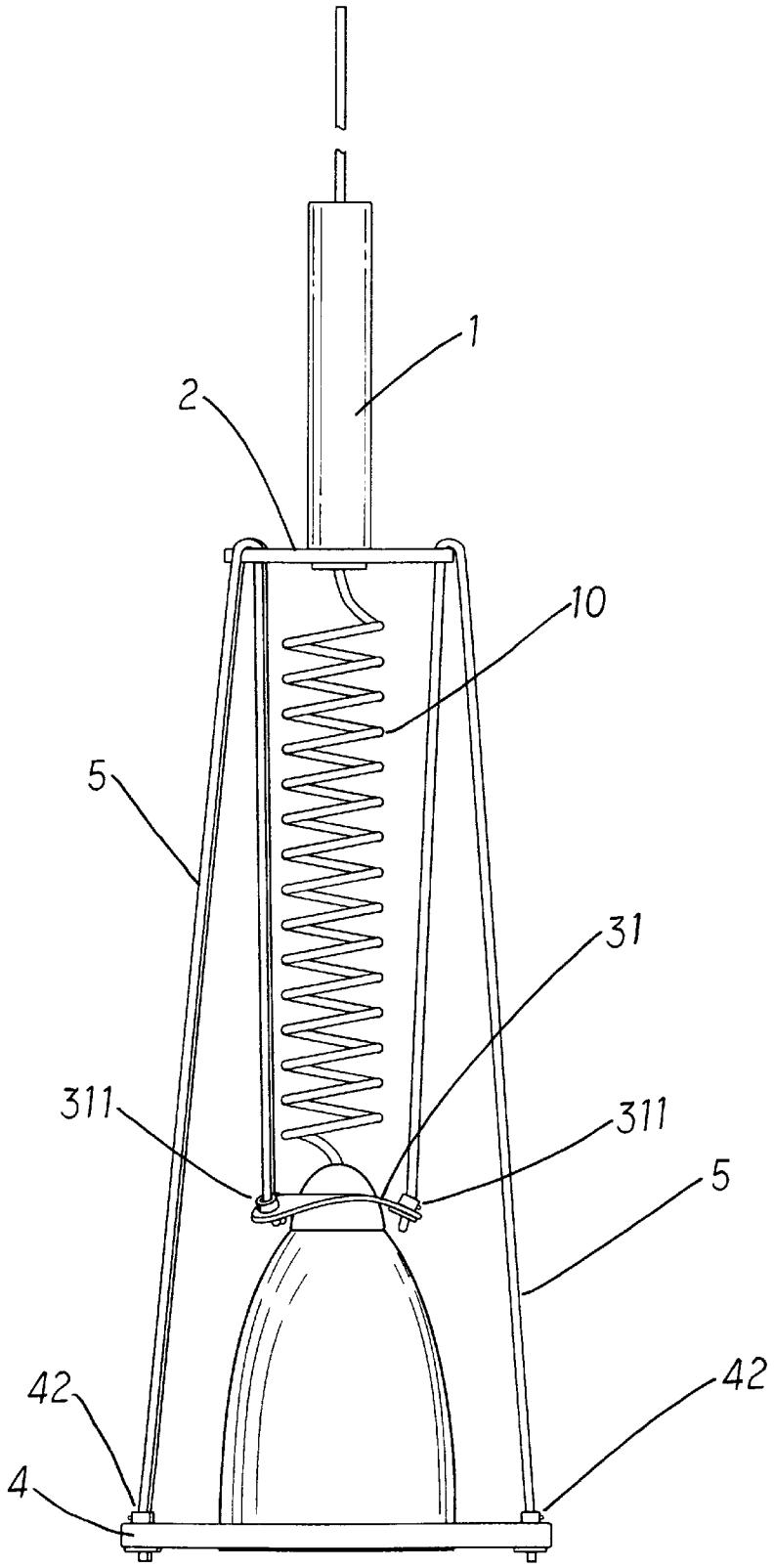
FIG. 4 is a front view with the lamp shade resting on the balance plate.

Referring to FIGS. 3 and 4 again, because the power cord 10 is a coiled electric wire, it can be stretched to buffer down stroke of the lampshade 3 when the lampshade 3 is pulled downwards to a lower elevation.

While only one embodiment of the present invention has been shown and described, it will be understood that various modifications and changes could be made thereunto without departing from the spirit and scope of the invention disclosed.

What the invention claimed is:

1. A pendant elevation and projecting angle adjusting structure comprising:

a suspension rod having a top end fastened to a holder at the ceiling of a building in a vertical position, a bottom end, and an axial center through hole through its top and bottom ends;

a locating disk fixedly fastened to the bottom end of said suspension rod, said locating disk comprising a center through hole fastened to the bottom end of said suspension rod by a hollow screw cap, and a plurality of wire holes equiangularly spaced around its center through hole;

a lampshade suspended below said locating disk and holding a lamp bulb on the inside, said lampshade comprising a top rack, said top rack having a plurality of mounting ends equiangularly spaced around the periphery thereof;

an electric wire inserted through the axial center through hole of said suspension rod and said hollow screw cap and connected to said lampshade for guiding electricity from power source to the lamp bulb in said lampshade;

a balance plate suspended below said locating disk at a distance, said balance plate comprising a circular center through hole for the passing of said lampshade, and a plurality of connecting points equiangularly spaced around its circular center through hole; and a plurality of pull ropes respectively inserted through the wire holes at said locating disks, said pull ropes each having a first end respectively connected to the mounting ends at said top rack of said lampshade, and a second end respectively connected to the connecting points at said balance plate.

2. The pendant elevation and projecting angle adjusting structure of claim 1 wherein said balance plate has a weight approximately equal to said lampshade.

3. The pendant elevation of projecting angle adjusting structure of claim 1 wherein said electric wire is a flexible, coiled cord.

* * * * *